US006408808B1

(12) United States Patent
Yi

(10) Patent No.: US 6,408,808 B1
(45) Date of Patent: Jun. 25, 2002

(54) DOHC DIESEL ENGINE CYLINDER HEAD

(75) Inventor: Se-Young Yi, Yongin (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/609,130

(22) Filed: Jul. 3, 2000

(30) Foreign Application Priority Data

Oct. 18, 1999 (KR) ..... 99-45079

(51) Int. Cl.[7] ..... F01L 1/02

(52) U.S. Cl. ..... 123/90.27; 123/90.39; 123/193.5; 123/193.3

(58) Field of Search ..... 123/90.27, 90.31, 123/90.39, 90.41, 90.42, 90.43, 90.44

(56) References Cited

U.S. PATENT DOCUMENTS

| | | | | | |
|---|---|---|---|---|---|
| 5,123,385 | A | * | 6/1992 | Sado | 123/193.5 |
| 5,207,197 | A | * | 5/1993 | Klingmann | 123/195 R |
| 5,357,916 | A | * | 10/1994 | Matterazzo | 123/90.16 |
| 5,531,194 | A | * | 7/1996 | Komatsu | 123/193.5 |
| 5,711,266 | A | | 1/1998 | Astner et al. | 123/193.5 |

FOREIGN PATENT DOCUMENTS

| | | | | |
|---|---|---|---|---|
| DE | 3408710 | * | 9/1984 | 123/90.27 |
| DE | 4208608 | C2 | 9/1993 | |
| DE | 4315233 | A1 | 7/1994 | |
| DE | 19620546 | A1 | 5/1996 | |
| EP | 0744530 | A1 | 11/1996 | |

* cited by examiner

*Primary Examiner*—Thomas Denion
*Assistant Examiner*—Jaime Corrigan
(74) *Attorney, Agent, or Firm*—Christie, Parker & Hale, LLP

(57) ABSTRACT

A DOHC diesel engine cylinder head includes a plurality of combustion chamber head sections having the same configuration, two camshafts rotationally mounted over the combustion chamber head sections, each having cam lobes for activating intake and exhaust valves, synchronizing means for driving the camshafts, the synchronizing means being connected to the camshafts, a camshaft carrier mounted on a top surface of the cylinder head for supporting the camshafts, and a valve cover for covering the cylinder head.

15 Claims, 7 Drawing Sheets

DOHC DIESEL ENGINE CYLINDER HEAD

BACKGROUND OF THE INVENTION (a) Field of the Invention

The present invention relates to a DOHC diesel engine, and in particular, to a cylinder head structure of the DOHC engine for providing improved engine maintainability.

(b) Description of the Related Art

Diesel engines are designed to operate on either two or four stroke-cycles. In a typical four-stroke engine, intake and exhaust valves are located in the cylinder head. Often, dual valve arrangements with two intake and two exhaust valves per cylinder, are employed.

A DOHC (dual overhead cam) engine with four valves per cylinder has two camshafts per cylinder head. Generally, one camshaft operates intake valves, the other operates exhaust valves. The intake and exhaust ports are commonly fashioned in a tandem, parallel, or twisted arrangement, and a fuel injector for each combustion chamber is provided for high-pressure fuel injection.

FIG. 1 is a cross-sectional view showing a cylinder head wherein the intake and exhaust ports are arranged in tandem. As shown in FIG. 1, the valves are parallel such that there are some advantages in that dead combustion chamber volume is reduced, the valve train can be compact, swirl is encouraged, and the mounting of glow plugs is facilitated. There are also shortcomings in that it is difficult to install and remove fuel injectors, and cooling efficiency is reduced.

FIG. 2 is a cross-sectional view showing a cylinder head wherein the intake and exhaust ports are arranged in parallel. As shown in FIG. 2, the valves are arranged to be non-parallel such that the space for installing and removing the fuel injector is increased. However, the non-parallel configuration of the valves causes the dead volume of the combustion chamber to increase and the valve train to be complicated. Furthermore, this parallel port arrangement increases intake resistance.

FIG. 3 shows a cylinder head wherein the intake and exhaust ports are arranged in a twisted fashion. The twisted port arrangement makes it easier for allows the intake ports to develop swirl, and it includes all the advantages of the tandem arrangement. However, the twisted port arrangement also has shortcomings in that it is difficult to install and remove the fuel injectors on the cylinder head.

To increase engine performance, there are many advantages to adapting the twisted port arrangement, such as increasing swirl efficiency and smoothing the intake and exhaust flow. It also more easily secures space for mounting the glow plug.

In addition, to adapt a common-rail type fuel injection system for reducing fuel injection pressure and noise, the fuel injector should be arranged in such a way that it is affixed on the valve cover.

However, in the prior art cylinder head, shown in FIG. 1 an injector clamp 17 is pre-mounted on the cylinder head.

SUMMARY OF THE INVENTION

The present invention has been made in an effort to solve the above problems of the prior art.

It is an object of the present invention to provide a DOHC diesel engine cylinder head that makes maintainability of the engine easy by modifying the cylinder head and valve structure.

To achieve the above object, a DOHC diesel engine cylinder head comprises a plurality of combustion chamber head sections having the same configuration, two camshafts rotationally mounted over the combustion chamber head sections, each having cam lobes for activating intake and exhaust valves, synchronizing means for driving the camshafts, the synchronizing means being connected to the camshafts, a camshaft carrier mounted on a top surface of the cylinder head for supporting the camshafts, and a valve cover for covering the cylinder head.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will be described hereinafter with reference to the accompanying drawings.

Figure 1:
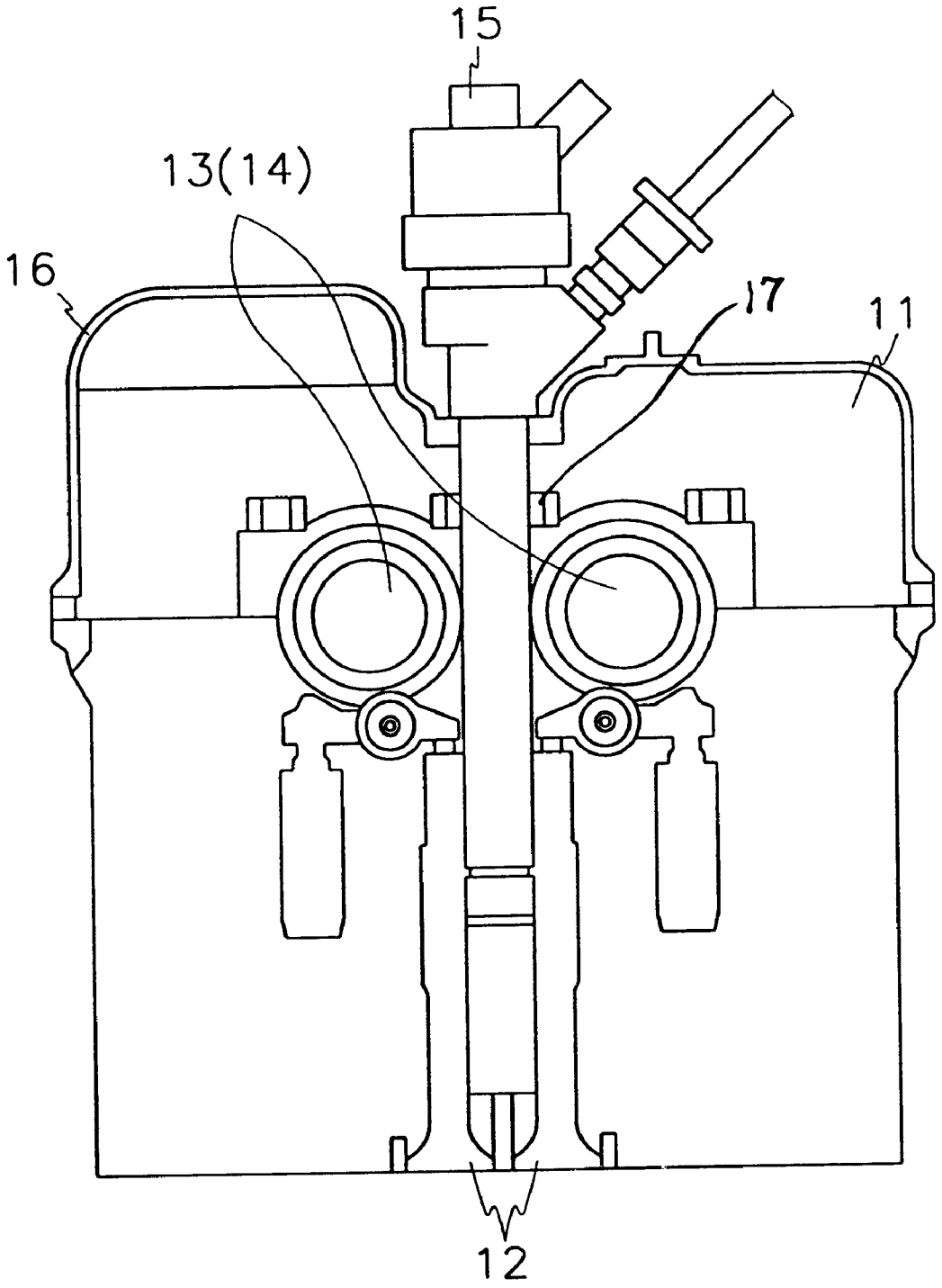
FIG.1 (Prior art)
FIG. 1 is a front cross-sectional view of a prior art cylinder head where a tandem intake and exhaust port system is used.
Figure 2:
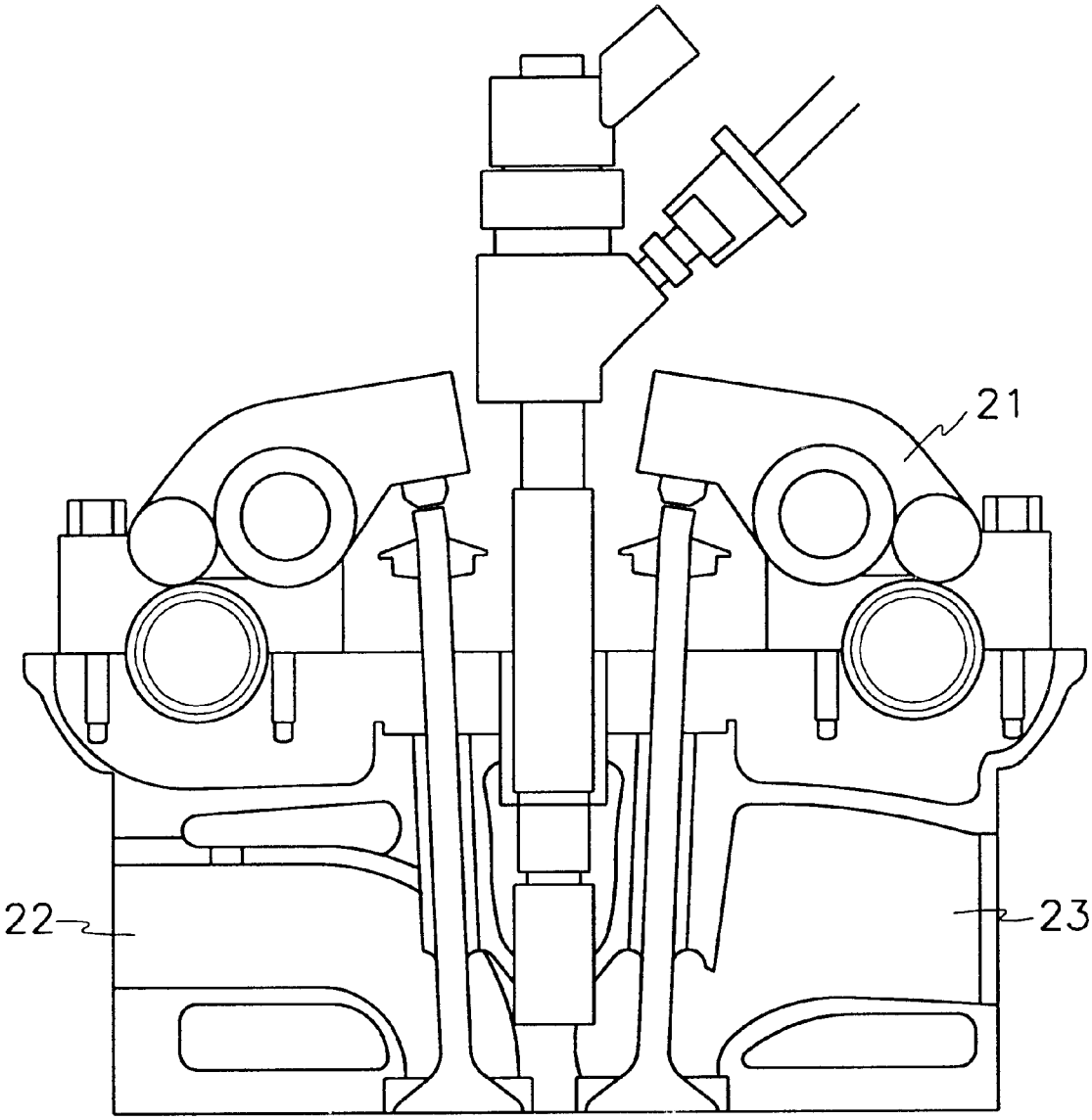
FIG.2 (Prior art)
FIG. 2 is a front cross-sectional view of a prior art cylinder head where a parallel intake and exhaust port system is used.
Figure 3:
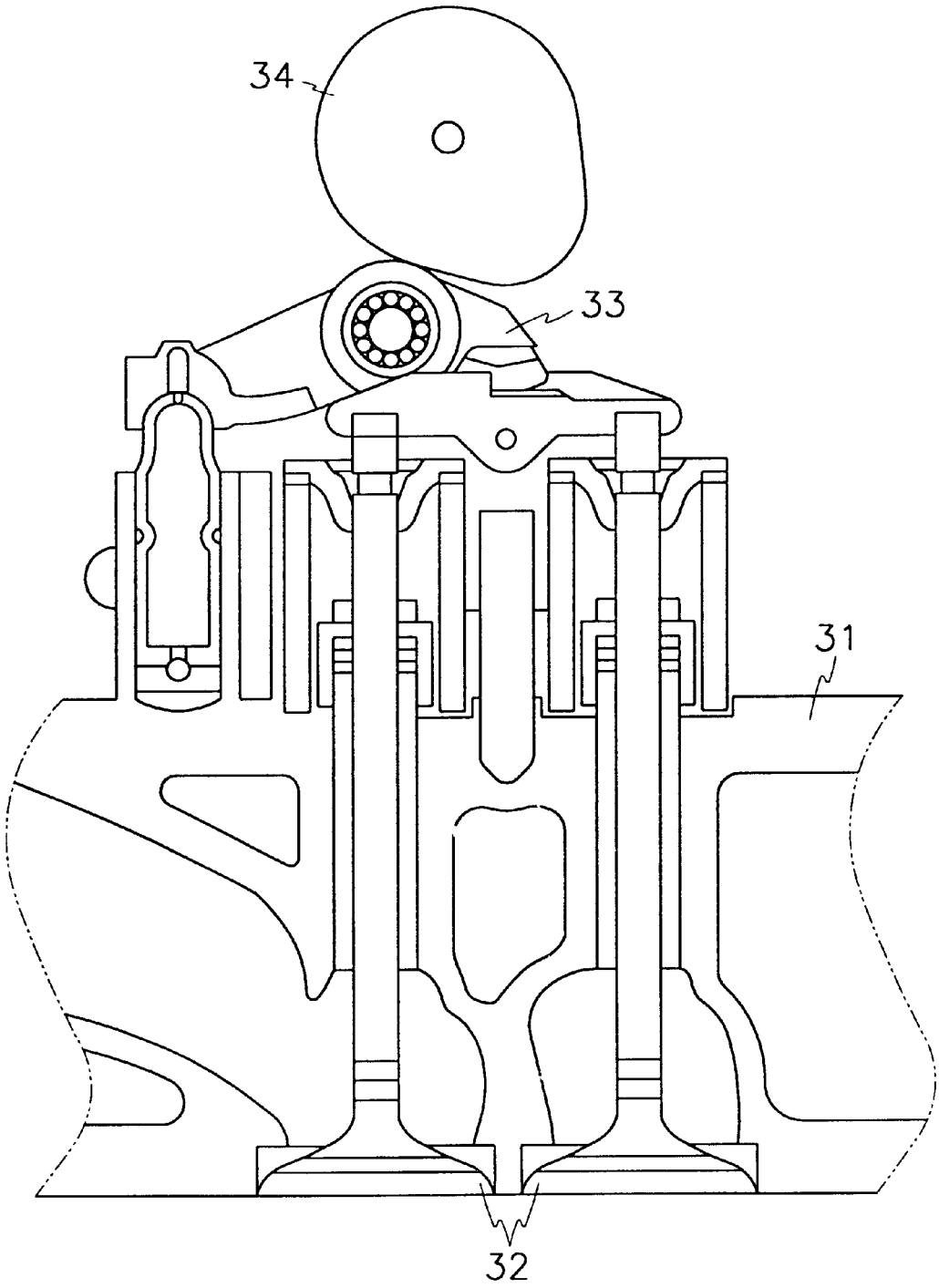
FIG.3 (Prior art)
FIG. 3 is a front cross-sectional view of a prior art cylinder head where a twisted intake and exhaust port system is used.
Figure 4:
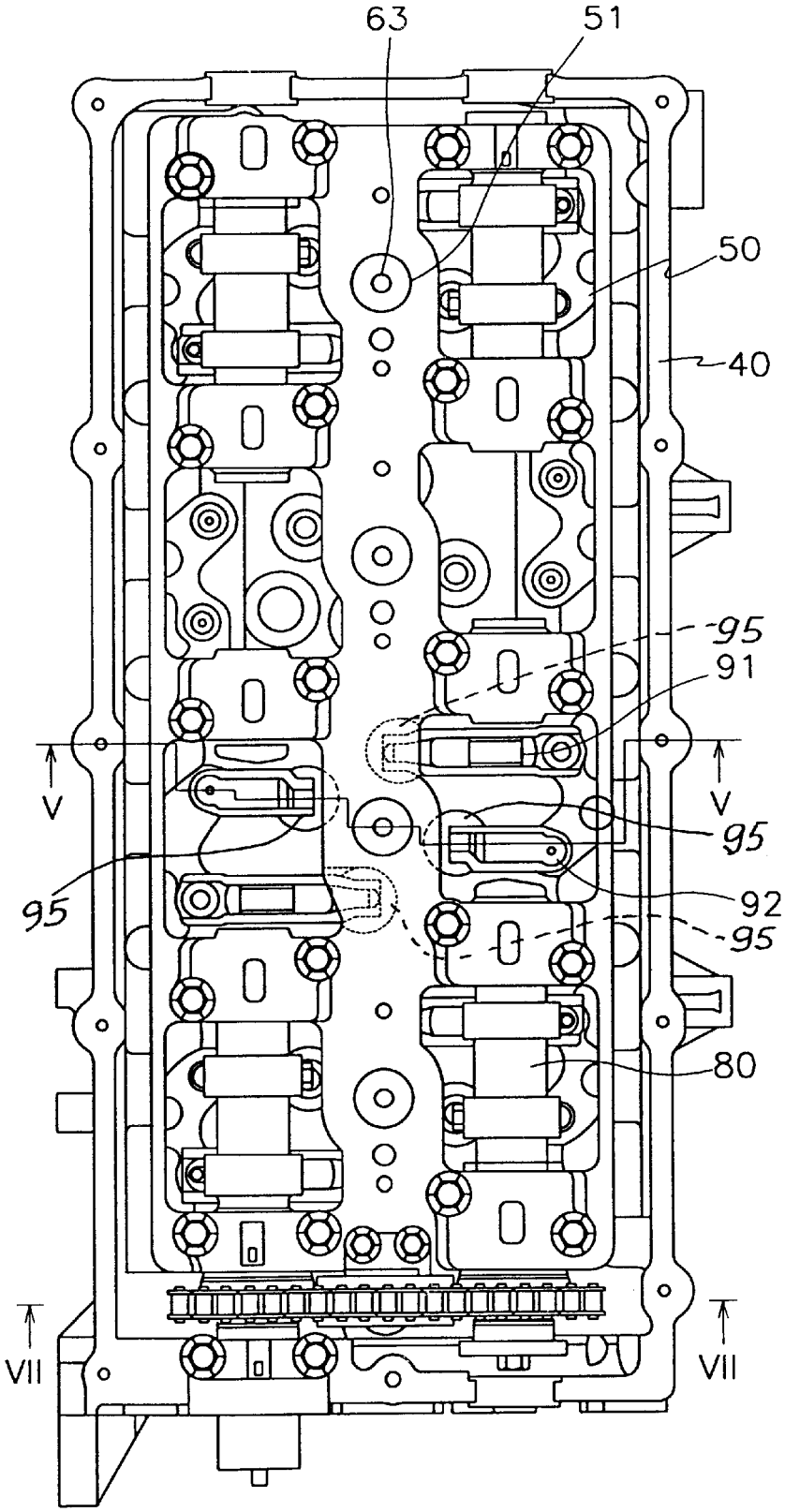
FIG. 4 is a top plane view showing a DOHC diesel engine cylinder head according to a preferred embodiment of the present invention.
Figure 5:
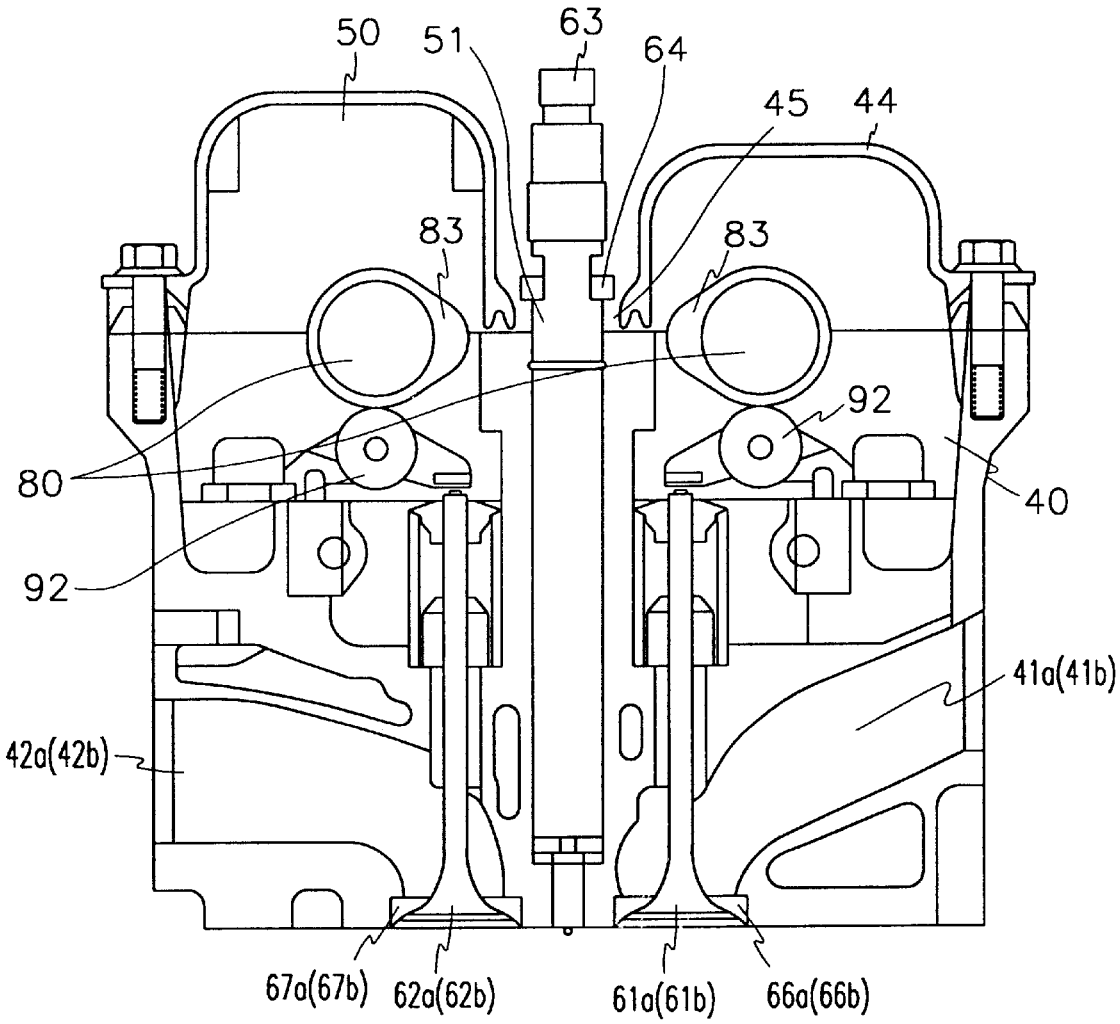
FIG. 5 is a cross-sectional view cut along the line V—V of FIG. 4.
Figure 6:
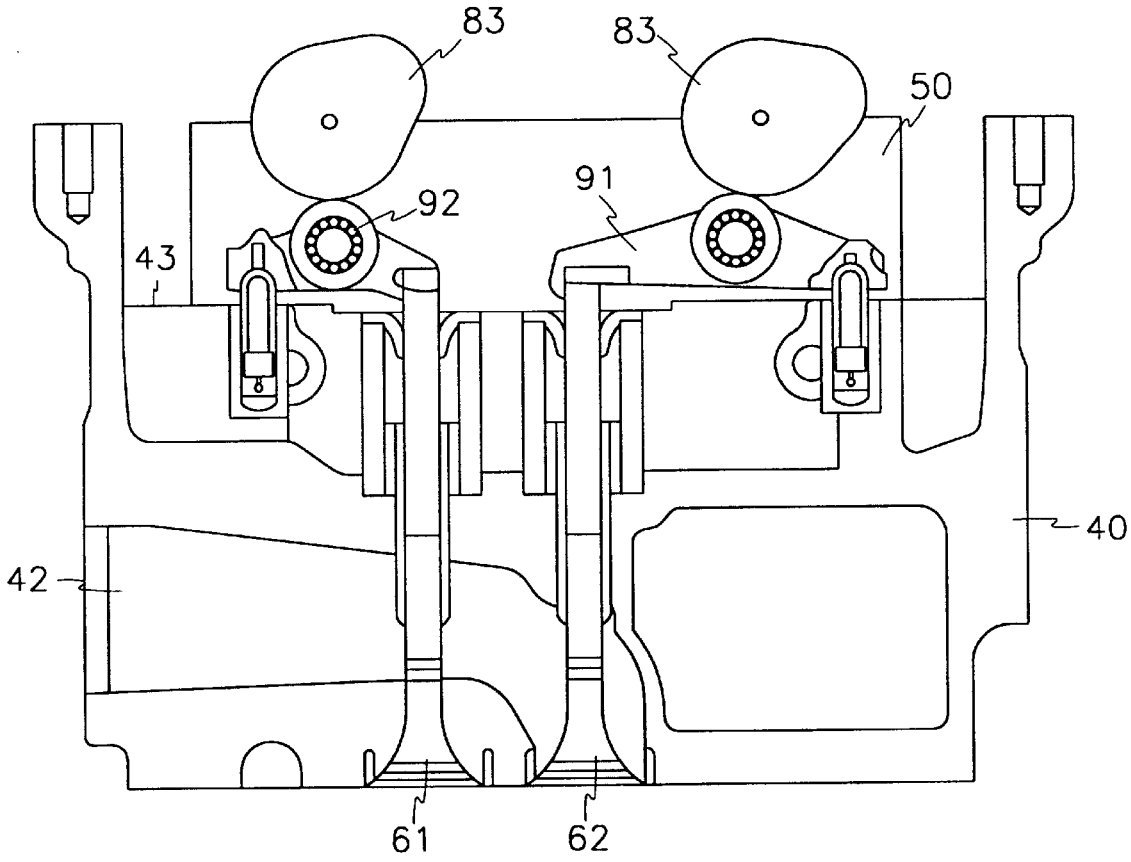
FIG. 6 is a schematic view showing an operation of rocker arms of an exhaust port of the DOHC diesel engine cylinder head of FIG. 4.

FIG. 4 is a top plane view showing a cylinder head of a DOHC diesel engine according to the preferred embodiment of the present invention, and FIG. is a cross-sectional view cut along the line V—V of FIG. 4. FIG. 6 is a schematic view showing an operation of rocker arms of an exhaust side of the cylinder head of FIG. 4.

As shown in drawings, the DOHC diesel engine cylinder head comprises a plurality of combustion chamber head sections. Each combustion chamber head section is provided with two intake valve openings 66*a* and 66*b* and two exhaust valve openings 67*a* and 67*b* communicating with the combustion chamber, two intake ports 41*a* and 42*b* and two exhaust ports 42*a* and 42*b* respectively communicating with the intake valve openings 66*a* and 66*b* and the exhaust valve openings 67*a* and 67*b*, two intake valves 61*a* and 61*b* and two exhaust valves 62*a* and 62*b* and the exhaust valve openings 67*a* and 67*b*, two pairs of long and short rocker arms 91 and 92 respectively engaged with the intake valves 61*a* and 61*b* and the exhaust valves 62*a* and 62*b*, and a fuel injector 63 mounted among each set of valves 61*a* (61*b*) and 62*a* (62*b*) such that its tip is inserted into the combustion chamber. The DOHC diesel engine cylinder head further comprises two camshafts 80 having a plurality of cam lobes 83 which actuate the rocker arms 91 and 92 that are supported by a camshaft carrier 50, which includes rocker arm openings 95 and covers the top surface of the cylinder head, as well as a valve cover 44 having a plurality of fuel injector insertion holes 45 through which the fuel injectors 63 can be inserted even after the cover 44 is mounted.

The camshaft carrier 50 is mounted inside a guide rail (not shown) formed around an upper edge of the cylinder head 40. Cam bearings are formed on the camshaft carrier 50, one on either side of each pair of rocker arms for each camshaft, such that the camshafts are supported by the cam bearings. A plurality of injector receiving holes 51 are formed on an upper plate of the camshaft carrier 50 such that the fuel injectors are installed and removed through the injector receiving holes 51.

The camshaft carrier 50 is formed with the rocker arm openings 95 such that the camshaft carrier 50 does not interfere with the operation of the rocker arms 91 and 92.

The intake valves 61*a* and 61*b* and the exhaust valves 62*a* and 62*b* are positioned at locations that are between 20° and 50° from the longitudinal axis of the cylinder head, and the long and short rocker arms 91 and 92 are alternately positioned along the camshafts.

The short rocker arms 92 are manufactured by an investment casting method in order to overcome the space limitations, and the long rocker arms 91 are manufactured by a stamping method. The fuel injectors 63 are inserted into the injector receiving holes 51 and are affixed to the camshaft carrier 50 by a clamp 64 installed at the injector insertion hole 45 of the valve cover 44.

Figure 7:
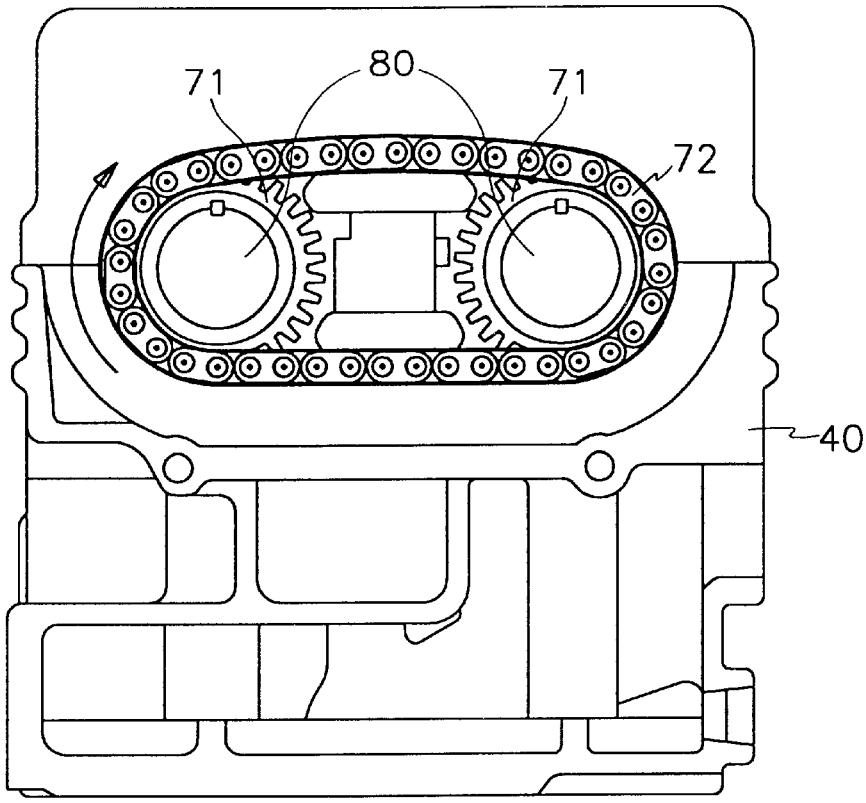
FIG. 7 is a cross-sectional view cut along the line VII—VII of FIG. 4.

As shown in FIG. 7, the camshafts 80 are rotationally joined by a synchronizing means comprising a sprocket 71 fixed to one end of each of the camshafts 80 and a chain 72 mounted around the sprockets 71 such that the camshafts 80 rotate in the same direction.

Figure 8:
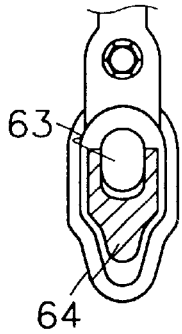
FIG. 8 is a detailed drawing showing a clamp for supporting the injector according to the preferred embodiment of the present invention.

FIG. 8 shows a clamp 64 that is mounted at the injector insertion hole formed on the valve cover so as to fix the fuel injector to the camshaft carrier from outside the valve cover.

The mechanical efficiency of the cylinder head according to the preferred embodiment of the present invention will be described hereinafter.

By adopting the camshaft carrier 50 acting as a camshaft bearing member, about 6 bolts for fitting the cylinder head are not needed, so space for mounting the camshafts 80, the fuel injectors 63, and the glow plugs (not shown) can be secured.

Also, since the valve cover 44 and the camshaft carrier 50 are respectively provided with injector insertion holes 45 and injector receiving holes 51 thereon, and the clamps 64 installed at the injector insertion holes 45 of the valve cover 44, the fuel injectors 63 can be installed and removed after the valve cover 44 and the camshaft carrier 50 are assembled.

The camshaft carrier 50 is provided with the rocker arm openings so as to prevent the rocker arms 91 and 92 from being interfered with by the camshaft carrier 50.

As shown in FIG. 4, the long rocker arms 91 and the short rocker arms 92 are alternately positioned in a zigzag pattern such that the space needed for installing the fuel injectors 63 is secured on the valve cover, and the long and short rocker arms 91 and 92 are used on both the intake and exhaust sides.

Furthermore, each camshaft 80 is provided with alternating intake and exhaust camshaft lobes so as to operate the intake and exhaust valves such that the length of the long and short rocker arms 91 and 92 are minimized, resulting in enhanced rigidity of the rocker arms 91 and 92.

With the twisted arrangement of the intake and exhaust ports 41*a*(41*b*) and 42*a*(42*b*), the intake ports can be effectively formed such that intake swirl can be maximized, so the combustion efficiency of the engine is enhanced, resulting in reducing exhaust gas emissions.

In addition, by reducing the number of bolts used for securing the cylinder head by adopting the camshaft carrier acting as a camshaft bearing, space for installing the camshaft, the fuel injectors, and the glow plugs can be secured. Furthermore, fuel injector manipulating space is secured on the valve cover by arranging the valves in a twisted configuration, and this minimizes the length of the rocker arms, and makes it possible to install and remove the fuel injectors without dismantling the valve cover.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A DOHC diesel engine cylinder head comprising:

a plurality of combustion chamber head sections having the same configuration;

two camshafts rotationally mounted over the combustion chamber head sections, each having cam lobes for activating intake and exhaust valves;

a chain coupling said two camshafts for driving the camshafts;

a camshaft carrier mounted on a top surface of the cylinder head for supporting the camshafts, the camshaft carrier having an injector receiving opening;

a valve cover for covering the cylinder head, the valve cover having an injector insertion opening;

a fuel injector inserted in the injector receiving opening; and a clamp clamping the fuel injector to the engine head, wherein the fuel injector can be inserted into the injector receiving opening through the injector insertion opening and clamped onto the head with the clamp without removing the valve cover, and wherein the fuel injector can be unclamped and removed from the head without removing the valve cover.

2. A DOHC diesel engine cylinder head of claim 1 wherein the combustion chamber head section comprises:

two intake valve openings and two exhaust valve openings communicating with a combustion chamber;

two intake ports and two exhaust ports respectively communicating with the intake valve openings and the exhaust valve openings;

two intake valves and two exhaust valves for respectively opening and closing the intake valve openings and the exhaust valve openings; and two pairs of rocker arms engaged with upper ends of the intake and exhaust valves.

3. A DOHC diesel engine cylinder head of claim 2 wherein the valves are positioned at locations that are between 20° and 50° from an longitudinal axis of the cylinder head.

4. A DOHC diesel engine cylinder head of claim 2 wherein the one pair of rocker arms comprises a long and a short rocker arm.

5. A DOHC diesel engine cylinder head of claim 4 wherein the long rocker arm is manufactured by a stamping method and the short rocker arm is manufactured by an investment casting method.

6. A DOHC diesel engine cylinder head of claim 1 further comprising a sprocket fixed to an end of each of the camshafts and wherein the chain is provided around the sprockets so as to force them to rotate at the same time.

7. A DOHC diesel engine cylinder head of claim 1 wherein each camshaft is provided with intake cam lobes and exhaust cam lobes.

8. A DOHC diesel engine cylinder head of claim 1 wherein the clamp is external of the valve cover.

9. A DOHC diesel engine cylinder head of claim 1 wherein the camshaft carrier comprises cam bearings.

10. A DOHC diesel engine cylinder head of claim 1 wherein the fuel injector comprises a tip inserted into a combustion chamber of one of said combustion chamber head sections.

11. A DOHC diesel engine cylinder head comprising:

a plurality of combustion chamber head sections having the same configuration;

two camshafts rotationally mounted over the combustion chamber head sections, each having cam lobes for activating intake and exhaust valves;

synchronizing means for driving the camshafts, the synchronizing means being connected to the camshafts;

a camshaft carrier mounted on a top surface of the cylinder head for supporting the camshafts;

a valve cover for covering the cylinder head;

two intake valve openings and two exhaust valve openings communicating with a combustion chamber;

two intake ports and two exhaust ports respectively communicating with the intake valve openings and the exhaust valve openings;

two intake valves and two exhaust valves for respectively opening and closing the intake valve openings and the exhaust valve openings;

two pairs of rocker arms engaged with upper ends of the intake and exhaust valves, wherein the one pair of rocker arms comprises a long and a short rocker arm; and a fuel injector having a tip inserted into the combustion chamber.

12. A DOHC diesel engine cylinder head of claim 11 wherein the long rocker arm is manufactured by a stamping method and the short rocker arm is manufactured by an investment casting methods.

13. A DOHC diesel engine cylinder head comprising:

a plurality of combustion chamber head sections;

two camshafts rotationally mounted over the combustion chamber head sections, each having cam lobes for activating intake and exhaust valves;

a chain coupling said two camshafts;

a camshaft carrier mounted on a top surface of the cylinder head for supporting the camshafts, the camshaft carrier having an injector receiving opening;

a valve cover for covering the cylinder head, the valve cover having an injector insertion opening;

a fuel injector inserted in the injector receiving opening; and a fastener fastening the fuel injector to the engine head, wherein the fuel injector can be inserted into the injector receiving opening through the injector insertion opening and fastened onto the head using the fastener without removing the valve cover, and wherein the fuel injector can be unfastened and removed from the head without removing the valve cover.

14. A DOHC diesel engine cylinder head of claim 13 wherein the fastener is external of the valve cover.

15. A DOHC diesel engine cylinder head of claim 13 wherein the fuel injector comprises a tip inserted into a combustion chamber of one of said combustion chamber head sections.

* * * * *